US005502979A

United States Patent [19]

Renard

[11] Patent Number: 5,502,979

[45] Date of Patent: Apr. 2, 1996

[54] COLLAPSIBLE REFRIGERATED CABINETS

[76] Inventor: André Renard, 131 chemin de Rigoumel - Résidence Les Noisetiers, 83100 Toulon, France

[21] Appl. No.: 318,684

[22] PCT Filed: Feb. 11, 1994

[86] PCT No.: PCT/FR94/00158

§ 371 Date: Oct. 11, 1994

§ 102(e) Date: Oct. 11, 1994

[87] PCT Pub. No.: WO94/17698

PCT Pub. Date: Aug. 18, 1994

[30] Foreign Application Priority Data

Feb. 12, 1993 [FR] France ..... 93 01970

[51] Int. Cl.[6] ..... A47F 3/04

[52] U.S. Cl. ..... 62/256; 62/298; 312/116

[58] Field of Search ..... 62/246, 255, 256, 62/298; 312/116, 401

[56] References Cited

U.S. PATENT DOCUMENTS

| | | | |
|---|---|---|---|
| 2,915,884 | 12/1959 | Haushalter et al. | 62/298 X |
| 3,719,408 | 3/1973 | Fullington et al. . | |
| 4,457,140 | 7/1984 | Rastelli | 62/298 X |
| 4,845,957 | 7/1989 | Richardson . | |
| 4,898,004 | 2/1990 | Richardson | 62/298 X |
| 5,086,627 | 2/1992 | Borgen | 62/298 X |
| 5,140,830 | 8/1992 | Sawyer | 62/298 |

FOREIGN PATENT DOCUMENTS

| | | |
|---|---|---|
| 296343 | 12/1988 | European Pat. Off. . |
| 1143565 | 10/1957 | France . |
| 2198030 | 6/1988 | United Kingdom . |

*Primary Examiner*—William E. Tapolcai
*Attorney, Agent, or Firm*—Ladas & Parry

[57] ABSTRACT

The present invention relates to a display cabinet for displaying food products or the like in a shop. A refrigerated cabinet for displaying products includes at least two substantially superposed shelves (1), at least one cover panel, means for guiding and circulating cool air towards the product display shelves, and includes a cover panel made of a material that is thin and lightweight and that includes card, the cover being removably mounted on a base (8) including means for guiding and circulating cool air. The technical field of the invention is that of manufacturing refrigerated cabinets.

20 Claims, 3 Drawing Sheets

COLLAPSIBLE REFRIGERATED CABINETS

The present invention relates to a cabinet for displaying food products or the like in a shop.

Numerous products need to be placed (in sales outlets) in cabinets or displays that are refrigerated (or cooled) by a flow of cold air in order to keep said products under acceptable conservation conditions.

Three main problems need to be solved for this type of cabinet: such cabinets must enable the product on sale to be displayed in a manner that provides maximum visibility for the consumer visiting the shop and coming close to the cabinet, thereby enabling the product to be shown off at its best, in particular by good lighting; in addition, such a cabinet must enable products to be conserved, and this is generally achieved by circulating cold air (inside the cabinet), generally in dynamic manner, i.e. driven by at least one cold air fan; numerous cabinets of this type have a plurality of superposed shelves and include in their front facade a zone giving substantially frontal access to the products on display via an opening of large dimensions provided in the front facade of said cabinet; said air circulation includes a curtain of air for preventing or limiting penetration of warm air into said cabinet via said zone that gives frontal access to the products on display.

Another general problem to be solved for this type of apparatus is to enable products to be loaded into the cabinet and unloaded therefrom quickly and easily.

A cabinet that substantially satisfies these functions is described, for example, in U.S. Pat. No. 3,719,408 (Fullington), which cabinet has a product display zone including a zone with frontal access, the cabinet including a cold air circulation circuit having a curtain of cold air that protects said front access opening, and a system for cooling the circulating air; said cabinet is designed to receive mobile carts that include a plurality of superposed shelves for receiving and displaying the products on sale.

Nevertheless, known cabinets as described in particular in that document suffer from numerous drawbacks.

That type of cabinet is very expensive and very difficult or impossible to take apart and reuse when altering the layout or the fittings of a shop, where such alterations in shops are becoming more and more frequent in order to attract customers.

Patent application EP 296 343 (Gervais Danone) describes a container for displaying products that are kept at low temperature on sales premises; that document describes a generally rectangular container or box which is open via its top face and has side walls that may be made of cardboard, in particular; the container may be disposed on a pallet; the container may receive a cooling device, either in a cavity or cutout in one of the side walls of the box, or else placed on the top portion of the box, which cooling device may be a cold accumulator pack or an apparatus including a cooling circuit that is provided with an evaporator suitable for cooling the air in a top zone of the box and containing the products on display.

Although the appliance described in that document facilitates loading and unloading products since they can be delivered in said box, that appliance does not provide for cold air to circulate in the container containing the products, so its use is limited to certain types of products for which the relatively small amount of cooling provided by the cooling module described in that document suffices; in addition, that appliance suffers from a major drawback in that it is completely ill-adapted to promoting the products put on sale, which products are piled up inside the box, which box does not provide good visibility of the products or easy consumer access thereto.

The problem posed therefore consists in providing a refrigerated cabinet or display which is very easily taken apart, while still satisfying the general problems raised by that type of appliance, namely: ensuring very good conservation of products by proper circulation of cold air, be it static or driven by cold air circulation fans, providing the consumer with excellent visibility of the products, enabling the products on display to be shown off to advantage, and providing the consumer with easy access to the products; the appliance must also be suitable for very easy loading and unloading of the products.

The object of the present invention is solved by providing a refrigerated display cabinet for displaying food products, e.g. including at least two shelves for displaying said products, which shelves are preferably removable and substantially superposed, said cabinet including means for cooling air and for guiding the cooled air towards said display shelves, which cabinet includes a zone giving access to the displayed products, in which a portion at least of said means for guiding the cooled air or for cooling the air is provided by easily dismantled cover panels, of low density and of small thickness.

Preferably, the means for guiding cooled air include, in particular, cover panels that are very easily dismantled and that are essentially constituted by a multilayer composite material including at least one layer or sheet of paper or card, and which are suitable for receiving on their outside faces printing or silk-screening making it possible to provide advertising messages on at least a fraction of the outside face of said cabinet, said messages being adapted to the products on display.

Advantageously, said cabinet includes a perforated internal panel for distributing cool air towards said products and/or said shelves, and it includes a cover or superstructure that is substantially in a single block and is semi-rigid, which cover is made of a material that is thin, lightweight, multilayer or laminated, and includes at least one layer or sheet of paper or card.

Advantageously, said cover includes shelf supports and means for circulating cold air towards said shelves enabling air to be injected from behind or above said shelves, which cabinet preferably includes means for taking up or recycling cool air from the bottom thereof, e.g. at the front of said cabinet.

Said cabinet includes said access zone which is preferably substantially frontal via an opening of large dimensions provided in the front face or facade of said cabinet, which front face or access zone is preferably inclined relative to the horizontal, e.g. being substantially vertical, said cabinet optionally including a curtain of air seeking to limit ingress of warm air to the inside of said cabinet via said zone giving frontal access to the products.

In the special case of a cabinet that is generally in the form of a rectangular parallelepiped, the solution to the problem posed consists more particularly in providing a refrigerated or cooled cabinet (or display) for displaying and selling food products or the like in a shop on at least two substantially superposed shelves, the cabinet including at least one side panel, at least one front panel, and at least one back panel, wherein said cover comprises said side and front panels and said back panel, which panels are connected together, e.g. by staples and/or by adhesive.

Said cabinet includes a base (or stand) constituting a support for said cover, which cabinet includes means for rapidly assembling and disassembling said cover relative to said base, and preferably said cover can be installed by hand on said base which forms a support therefor by means of a substantially downwards vertical movement enabling it to surround or cover said base.

Preferably, said staples are made of plastics material, e.g. being in the form of flat-headed pins, or in the form of pairs of portions, a male portion and a female portion that make up a "presser stud", thereby enabling the panels to be assembled to one another in non-releasable manner.

Advantageously, at least one of said side, front, and back panels, and/or said material constituting said panels is of a density that is less than or equal to 400 kilograms per cubic meter, e.g. less than or equal to 300 kilograms per cubic meter, and preferably at least one of said panels has a thickness that is less than or equal to 30 millimeters, e.g. about 20 to 25 millimeters, and preferably said panels and/or said multilayer material constituting them has a relatively low coefficient of heat transmission and relatively low strength, such that said panels and/or said cover constituted by said panels is/are capable of being assembled or disassembled or interchanged by hand very quickly; said panels and/or said multilayer material constituting them preferably include(s) at least one outer sheet (coating) of paper, card, or plastics material film, which is printed, silk-screened, . . . .

Naturally, the invention can be applied to refrigerated cabinets of all shapes, particularly those which are substantially cylindrical in shape, e.g. being circular in section and preferably about an axis that is substantially vertical, and also to cabinets that are generally pyramid-shaped, for example.

In a first embodiment, said panels (which may constitute said cover and/or said shelves and/or said optionally perforated panels for guiding and distributing cool air) may be constituted by two (or three as the case may be) layers of superposed corrugated card which are held together by at least three (or at least four as the case may be) substantially plane layers of card; said layers or sheets of card may, for example, be paraffin-coated.

In a second embodiment, said panels may be essentially constituted by two thin layers (outer layers) of card between which a thick layer (an inner layer) of thermal insulation is provided, e.g. of polystyrene or of polyurethane.

Advantageously, said support-forming base includes a top portion that is substantially in the form of a rectangular parallelepiped and that has corners or angles that are substantially rounded or smooth, and in a bottom portion of said support there are included support means (stop means or abutment means) for at least a portion of the bottom edge of said cover.

Advantageously, said base includes at least one finned heat exchanger for cooling the air that circulates inside said cabinet, which heat exchanger may be constituted, for example, by an evaporator fed with refrigerating fluid from a compressor refrigeration circuit, e.g. comprising a compressor, a condenser, and an expander, in particular, which base includes at least one fan for circulating said air cooled by said heat exchanger.

Alternatively, said heat exchanger may be constituted by a cooling battery through which there flows a refrigerating fluid such as glycol-containing water, for example, which refrigerating fluid may be fed to said cabinet from a refrigerator unit external to said cabinet, and said base includes at least one fan for circulating said cooled air.

Advantageously, at least one of said side, front, and back panels is provided with a cutout defining an opening suitable for coinciding with or overlying an opening formed in a side wall of said base, which openings allow a fluid such as air to pass, e.g. to enable the refrigerating fluid to be cooled in a condenser placed in the circuit of said refrigerating fluid.

Advantageously, said cabinet includes feet or longitudinal beams which define at least one empty space enabling the forks of a handling device to be engaged beneath said support-forming base, thereby facilitating handling of said base and/or of said cabinet.

Advantageously, said cabinet includes air sealing means between said base and said cover.

Advantageously, said shelves are made of a multilayer or laminated material including at least one layer of paper or card; said perforated internal panel may also be made of a multilayer or laminated material including at least one layer or sheet of paper or card; said cabinet may include a sealing panel that is transparent, at least in part, thereby enabling products disposed on said shelves to be illuminated by a light source external to said cabinet.

Advantageously, said cabinet includes switch means for switching on and off a refrigerating unit and/or said fan for circulating air provided in said base, which switch is operated (activated or deactivated) by contact or by a proximity detector during assembly (or disassembly as the case may be) of said cover on said base.

Display cabinets of the invention present numerous advantages.

Because of said panels that guide the cooled air inside said cabinet, and that include on their outside faces respective sheets suitable for being printed or silk-screened, said cabinets are very light in weight and easily dismantled, and they can thus be easily moved inside a shop when altering the layout of a shop.

Cabinets of the invention are also particularly adapted for use as cabinets which are placed in shops by distributors of a particular range of products and that are intended to show off those products, in particular when they are being promoted. Distributors frequently implement such promotions by placing cabinets at the ends of the ordinary display shelving in a shop for a period that may be quite brief (a few days to a few weeks).

In a preferred embodiment where said cabinet includes a cover or superstructure that is substantially entirely made of said multilayer material using panels that are connected together by staples and/or by adhesive, the entire superstructure of said cabinet can be removed almost instantaneously from its support or base that includes the cooling means, and can be discarded or replaced by a new structure or cover.

It should be observed that said superstructure or cover may advantageously perform the function of supporting said shelves and said products displayed in the cabinet, and provides excellent visibility of the displayed products, thereby showing them off to best effect.

In particular when using embodiments having transparent cutouts provided in the side panels of the cover of said cabinet, and optionally in the ceiling panel of said cabinet and forming a portion of its cover, the display of products can be further improved by facilitating the penetration of light into said cabinet, which light comes from light sources external to said cabinet.

Because of said sealing means provided between said cover (or superstructure) and said support-forming base which contains the means for cooling air, cabinets of the invention enable cold air to be circulated with limited losses or leaks of cold air, thereby making it possible to guarantee that the displayed products are properly conserved.

Advantageously, said material constituting said panels of said cover or superstructure include a large quantity of card, such that said cover can be discarded after being used for a few weeks or months, which cover can be recycled and used, for example, in the manufacture of other cover panels for such cabinets.

In a particular embodiment, in which said shelves for displaying products are made of said multilayer material that may be based essentially on card, said shelves may be used for packaging and transporting the display products and may be put into place by shop staff directly into said cabinet, without any particular unwrapping of products that are wrapped and carried by said shelf.

It should be observed that the panels and/or cover including said panels and/or said complete superstructure for cabinets of the invention can be manufactured industrially at very low cost, thereby enabling them to be replaced at very short time intervals of the order of a few weeks to several months, thereby solving the problem of maintenance as applied to cabinets for displaying products where the cabinets are subjected to considerable wear and tear such that the outside appearance thereof (using known cabinets) becomes rapidly degraded, thereby preventing them from performing their function of attracting customers.

In addition, in a particular embodiment of the invention in which said cover and said shelves are made of said multilayer material, said cover and said shelves may be assembled together in the factory and may be used as the packaging (in the factory) for transporting the products to be displayed, the entire assembly of cover, shelves, and products constituting a semi-rigid unit assembly that can be delivered to the sale point shop and put into place in the shelving merely by being engaged on said base.

The numerous advantages provided by the invention will be better understood from the following description which refers to the accompanying drawings that show particular embodiments of display cabinets of the invention, without limiting the invention thereto in any way.

Figure 3:
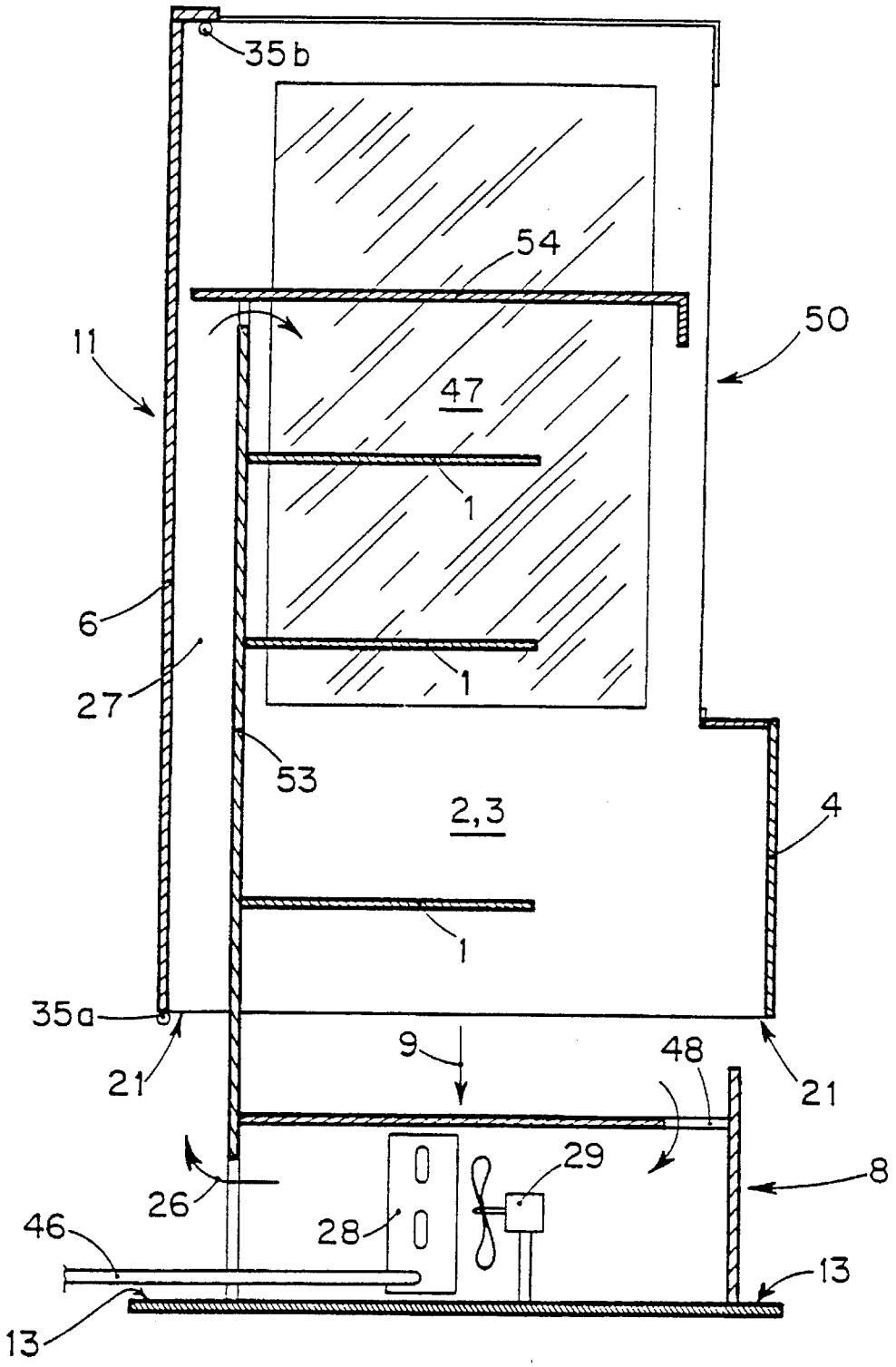

FIG. 3 is a cross-section on a substantially vertical plane through another embodiment of a cabinet of the invention in which said base and the heavy structure (e.g. made of metal) of said cabinet includes the perforated panel and the shelves and the support therefor; this figure shows a cover of the invention during a step of assembling said cover on said cabinet structure that includes said base.

Figure 1:
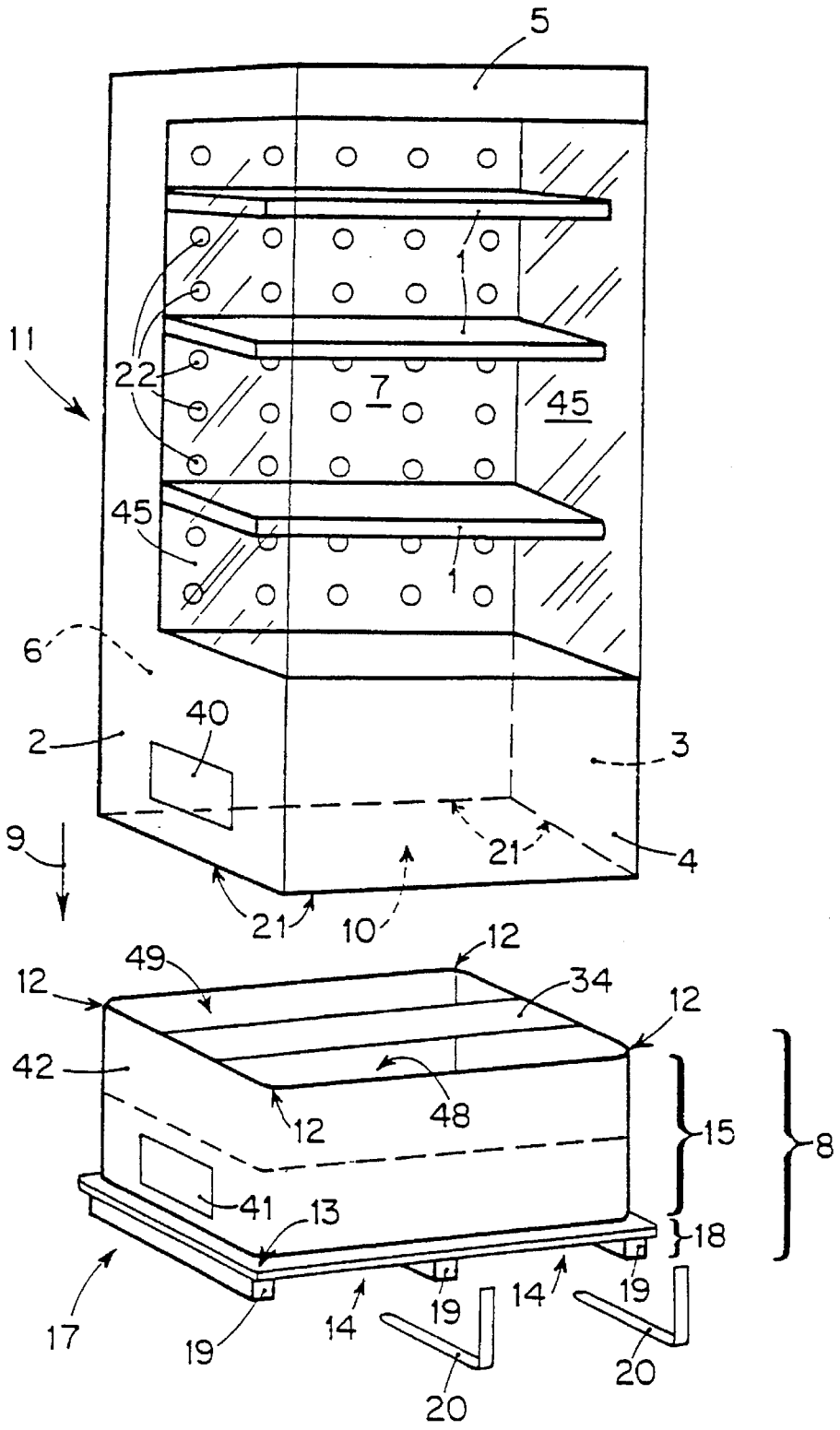
FIG. 1 is a diagram showing the main components of a refrigerated cabinet of the invention.

With reference to FIG. 1, there can be seen a cabinet 17 of the invention that essentially comprises a base 8 forming a support for a superstructure 11 suitable for being assembled on said base or for being mounted thereon by being moved in the direction of an arrow referenced 9, i.e. merely by engaging said superstructure (that is substantially in the form of a bottomless rectangular parallelepiped, i.e. its bottom face 10 is open) such that the cover covers said base.

The base includes a bottom portion 18 having a substantially horizontal plane plate whose margins 13 constitute support means for the edges 21 of the panels making up said cover, when the cover is covering said base 8.

Said bottom portion 18 of the base 8 also includes cross-beams 19 on which said plane plate is mounted, which cross-beams define empty spaces between said plane plate and the ground on which said plate is placed, the empty spaces 14 being suitable for receiving the forks 20 of a handling truck or apparatus of known type, thereby facilitating handling of said base and/or of said refrigerated cabinet.

Said base has a top portion 15 constituted by a kind of substantially rectangular box whose substantially vertical edges or angles situated in its four corners are preferably rounded or smoothed so as to facilitate engaging said cover 11 around said rectangular shape of said top portion 15 which is generally in the form of a rectangular box.

Figure 2:
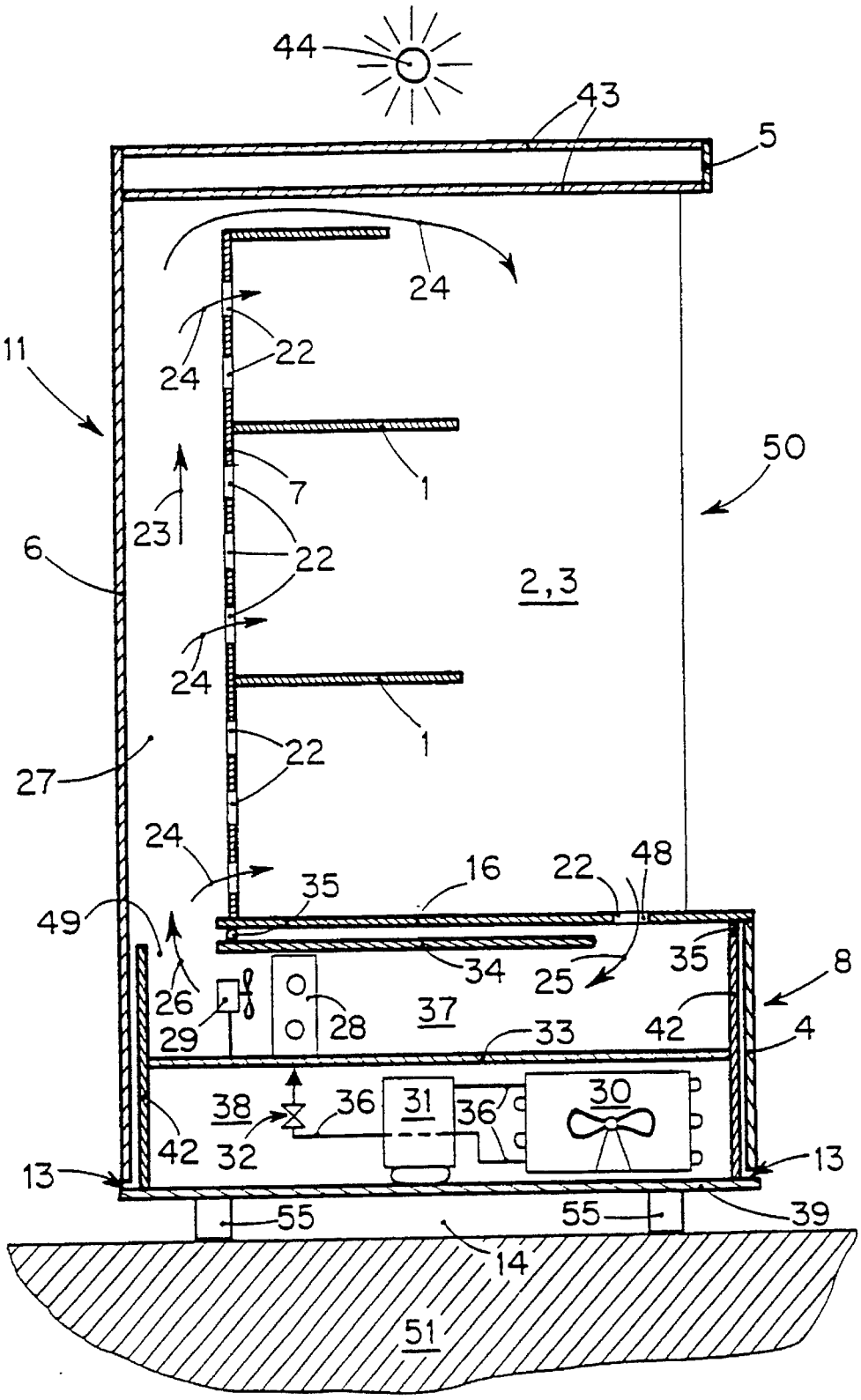
FIG. 2 is a cross-section on a substantially vertical plane through a display cabinet of the invention that includes a superstructure which may be substantially entirely made of a card-based multilayer material and which is placed on a base containing said cooling and cool air ventilation means.

Said substantially rectangular box forming the top portion 15 of said base 8 includes an opening 41 situated in one of the side walls 42 of said top portion 15, and in its top face it includes an opening 48 for receiving cool air coming from the front bottom portion of said cabinet, as shown in FIGS. 2 and 3, which top face of said base also includes a panel 34 provided with means for sealing engagement with said covering superstructure 11; said top face of said top portion 15 of said base 8 also includes an air outlet zone 49 for expelling air after it has been cooled by passing over a cooling battery for cooling said air, as likewise shown in FIG. 2.

Said superstructure 11 of said cabinet may be constituted essentially by a left said panel 2, a right side panel 3, a bottom front panel 4, a top front panel 5, and a back panel 6, which panels 2, 3, 4, 5, and 6 are preferably made of said card-based material and are assembled together by adhesive or by staples.

Said superstructure 11 may also include a panel 7 provided with perforations 22, situated behind shelves 1 which may be substantially horizontal or which may slope slightly forwards in order to facilitate visibility and access to the product for the consumer; said perforated panel 7 and said shelves 1 may, in certain embodiments, likewise be made of said card-based multilayer material.

Said left and right side panels 2 and 3 are thus designated with reference to an observer placed in front of the open front zone or product access zone (given reference 50 in FIG. 2), and observing the cabinet of the invention.

It can also be seen that said left and right side panels include respective transparent portions 45 for improving and facilitating lighting of the products on display on said shelves 1.

It can also be seen that said left side panel 2 includes a cutout in its bottom portion defining an opening 40, such that when said superstructure or cover has its bottom edges 21 standing on said support means 13 of said base, the opening 40 coincides with and overlies said opening 41 provided in the side wall 42 of said base, thereby allowing air to enter and/or leave said base, which air may be necessary when using a cooling system having a compressor provided with a condenser and housed inside said base, e.g. as in the embodiment shown in FIG. 2.

With reference to FIG. 2, it can be seen that said base 8 may include, in this embodiment, legs 40 cooperating with the ground 51 to define spaces 14 enabling said base and/or said cabinet to be handled.

At its bottom, said base 8 includes a bottom plate 39 whose margins constitute support zones 13 on which said superstructure stands.

Said base includes a bottom compartment 38 or "hot" compartment in which there may be situated a ventilated condenser 30, and a compressor 31 for a refrigerating fluid that circulates in pipework 36 connecting said compressor to said condenser, said condenser having an expander 32 feeding an evaporator 28 serving to cool air that comes into contact with said evaporator.

It should be observed that the circuits of said refrigerator unit are shown in part and diagrammatically in order to facilitate comprehension of FIG. 2.

Said hot bottom compartment 38 of said base 8 is separated by a substantially horizontal wall 33 from a "cold" compartment 37 situated above said compartment 38, which compartment 37 is defined firstly by side walls 42 of said base, and secondly by said panel 33 and by a top panel 34, there being an opening 48 provided in the front portion thereof to enable cool air to be recycled through the front bottom portion of the cabinet, as indicated by arrow 25, e.g. via perforations 22 provided in the bottom display shelf 16 for products and that forms a portion of said cover and/or of said structure of said cabinet.

Said compartment 37 includes said evaporator 28, e.g. constituted by a finned evaporator and serving to cool the air that escapes from the compartment 37 via an opening 49 situated behind said base (relative to arrow 26) under drive from an air circulation fan 29; said cooled air moves substantially vertically 23 in an air circulation duct 27 defined by two substantially vertical and mutually parallel panels forming a portion of the cover and of the superstructure of the cabinet, namely: a perforated back panel 7 which may optionally serve to support the shelves 1 and which is provided with a plurality of perforations 22 enabling the cooled air circulating in said back duct 27 of said cabinet to penetrate into the front portion of said cabinet (arrow 24) towards the products displayed on said shelves; said back duct 27 of said cabinet is also defined by said back panel 6 of said cover.

Said cabinet includes an air sealing gasket 35 which may be provided on said base and/or said cover, in the vicinity (e.g. surrounding) of said cool air inlet and outlet openings 48 and 49 of said compartment 37 of said base 8.

In the top portion of said cabinet, there may be provided one or two ceiling or roof panels 43 which are advantageously transparent or translucent at least in part in order to allow light produced by a source 44 such as a lamp or a neon disposed outside and above said cabinet to penetrate into the inside of said cabinet.

In the top portion of said cabinet, a front top front panel 5 is also provided, with the front panel 5 and the ceiling panel 43 being connected to the side panels 2 and 3 and to said back panel 6 preferably by adhesive and/or staples.

Said cover also includes in its front bottom portion, a portion 16 of said bottom shelf including said perforations 22 and enabling said recycling of cool air as shown by said arrow 25, and it includes an external portion or front bottom panel 4, which bottom and top front panels (respectively 4 and 5) may advantageously be provided with an outer layer of paper or card that is silk-screened or printed so as to receive advertising messages or symbols or pictures for attracting the attention of the consumer.

With reference to FIG. 3, it can be seen that in this embodiment, said cabinet includes said cover 11 constituted essentially by said back panel 6, said bottom front panel 4, and said side panels 2 and 3 each including a cutout (or opening) 47 which is closed by a sheet of transparent material in order to improve visibility of the products displayed on the shelves 1.

At the top, said cover includes sealing means **35*b* to limit cold air leaks when the cover 11 has been put into place so as to cover the base 8 by downwards vertical movement along arrow 9**.

In the bottom rear portion of said back panel, said cover also includes air sealing means **35*a*** between said base and said cover.

In this embodiment, said base 8 including said compartment 37 provided with said air recycling zone 48 has a battery 28 that may be fed via a pipe 46 with a cold fluid such as glycol-containing water, which cooling fluid may be taken from a refrigerator unit (not shown) external to said cabinet.

Said compartment 37 also includes said fan for circulating the cooled air which, after passing over said battery 28, can rise inside said duct 27 essentially defined by said back panel 6 of said cover and said perforated panel 53 until it reaches the top of said cabinet and returns towards the front thereof.

In the embodiment of FIG. 3, said rigid base 8 may be connected to a portion of the superstructure which is made of a material that is rigid and durable, e.g. steel, and which includes said corrugated back panel 53, said shelves 1, and a roof panel 54.

I claim:

1. A refrigerated cabinet for displaying products on at least two substantially superposed shelves, said cabinet including a means for guiding and circulating cool air;

a means for distributing said cool air towards said shelves;

a base that incudes a portion of said means for guiding and circulating cool air; and, a cover including cover panels made of a thin and lightweight card-based material, which cover is removably mounted on said base.

2. A cabinet according to claim 1, wherein said cover panels are of a density that is less than or equal to 400 kilograms per cubic meter and have a thickness that is less than or equal to 30 millimeters.

3. A cabinet according to claim 1, wherein said base forming a support for said cover includes a top portion which includes substantially rounded edges to facilitate engaging said cover around said base.

4. A cabinet according to claim 1, wherein at least one of said cover panels is provided with an opening suitable for coinciding with an opening formed in a side wall of said base, which openings allow air to pass.

5. A cabinet according to claim 1, wherein said base includes legs or longitudinal beams delimiting at least one empty space enabling the forks of a handling device to be engaged beneath said support-forming base.

6. A cabinet according to claim 1, further including air sealing means between said base and said cover.

7. A cabinet according to claim 1, wherein said shelves are made of a card-based material.

8. A cabinet according to claim 1, wherein said cover comprises:

a back cover panel and a ceiling cover panel;

side cover panels; and, a bottom front cover panel and a top front cover panel; said cabinet further comprising an open front product access zone protected by a curtain of air.

9. A cabinet according to claim 1, further comprising an open product access zone protected by a curtain of air.

10. A cabinet according to claim 1, wherein said means for distributing cool air towards said shelves include a perforated internal panel which is made of a card-based material.

11. A cabinet according to claim 1, wherein said cover panels are made of corrugated cardboard.

12. A refrigerated display cabinet comprising:

a base having a heat exchanger for cooling air and a fan for circulating cool air;

a dismantable superstructure which is mounted on said base and including at least two superposed shelves, means for guiding cool air and means for distributing cool air towards said shelves, and, a cover constituted by cover panels formed a thin and lightweight card-based material, said cover being removably mounted on said base to surround said base and includes an open product access zone protected by a curtain of air.

13. A cabinet according to claim 12, wherein said cover panels are of a density that is less than or equal to 400 kilograms per cubic meter and have a thickness that is less than or equal to 30 millimeters.

14. A cabinet according to claim 12, wherein said base forming a support for said cover includes a top portion which includes substantially rounded edges to facilitate engaging said cover around said base.

15. A cabinet according to claim 12, wherein said cover comprises a back cover panel and a ceiling cover panel, side cover panels, and, a bottom front cover panel and a top front cover panel, said cabinet further comprising an open front product access zone protected by a curtain of air.

16. A cabinet according to claim 12, wherein at least one of said cover panels is provided with an opening suitable for coinciding with an opening formed in a side wall of said base, which openings allow air to pass.

17. A cabinet according to claim 12, wherein said base includes legs or longitudinal beams delimiting at least one empty space to enable forks of a handling device to be engaged beneath said support-forming base.

18. A cabinet according to claim 12, wherein said shelves are made of a card-based material.

19. A cabinet according to claim 12, wherein said means for distributing cool air towards said shelves include a perforated internal panel which is made of a card-based material.

20. A refrigerated display cabinet comprising:

a base having a heat exchanger for cooling air circulating in said cabinet and a fan for circulating cool air;

a dismantable superstructure which is mounted on said base and includes at least two superposed shelves for displaying products and a duct for guiding cool air which includes a perforated panel for distributing cool air towards said shelves; and, a cover comprising:

a back cover panel and a ceiling cover panel, side cover panels, a bottom front cover panel and a top front cover panel, wherein said cover panels and said perforated panel are made of corrugated cardboard, said cover being removably mounted on said base to surround said base and includes an open product access zone protected by a curtain of air.

* * * * *